US007429903B2

(12) United States Patent
Antkowiak

(10) Patent No.: US 7,429,903 B2
(45) Date of Patent: Sep. 30, 2008

(54) DUAL DIRECTIONAL COUPLER WITH MULTI-STEPPED FORWARD AND REVERSE COUPLING RODS

(75) Inventor: Marek E. Antkowiak, Berkeley Heights, NJ (US)

(73) Assignee: R&D Microwaves LLC, Berleley Heights, NJ (US)

( * ) Notice: Subject to any disclaimer, the term of this patent is extended or adjusted under 35 U.S.C. 154(b) by 237 days.

(21) Appl. No.: 11/388,562

(22) Filed: Mar. 24, 2006

(65) Prior Publication Data

US 2007/0222539 A1 Sep. 27, 2007

(51) Int. Cl.
*H01P 5/18* (2006.01)

(52) U.S. Cl. ..... 333/115; 333/109

(58) Field of Classification Search ..... 333/109, 333/115, 116

See application file for complete search history.

(56) References Cited

U.S. PATENT DOCUMENTS 2,606,974 A * 8/1952 Wheeler ..... 333/115
3,113,277 A * 12/1963 Casper et al. ..... 333/116
3,508,170 A * 4/1970 Poulter ..... 333/115
5,424,694 A * 6/1995 Maloratsky et al. ..... 333/112
5,625,328 A * 4/1997 Coleman, Jr. ..... 333/116
6,066,994 A 5/2000 Shepherd et al. ..... 333/109
6,573,807 B2 6/2003 Noe ..... 333/116
6,600,307 B2 7/2003 Turski et al. ..... 324/95

* cited by examiner

*Primary Examiner*—Benny Lee
(74) *Attorney, Agent, or Firm*—St. Onge Steward Johnston & Reens LLC

(57) ABSTRACT

A dual directional coupler includes a housing, a main conductor, a forward coupled conductor and a reverse coupled conductor. The main conductor, the forward coupled conductor and the reverse coupled conductor are arranged in parallel within the housing such that the main conductor and the forward coupled conductor define a first two section quarter wave directional coupler, and the main conductor and the reverse coupled conductor define a second two section quarter wave directional coupler.

36 Claims, 7 Drawing Sheets

| Dimension | L | B1 | B2 | SP | S | B2 | D1 | D2 | D3 |
|---|---|---|---|---|---|---|---|---|---|
| Value [mm] | 27.94 | 7.77 | 4.72 | 4.83 | 9.66 | 4.72 | 4.19 | 4.01 | 2.59 |

DUAL DIRECTIONAL COUPLER WITH MULTI-STEPPED FORWARD AND REVERSE COUPLING RODS

FIELD OF THE INVENTION

The present invention relates generally to directional couplers, and more specifically to quarter wavelength dual directional couplers of improved design and manufacturability.

BACKGROUND OF THE INVENTION

A directional coupler has a through line through which a signal passes and at least one coupled line that samples the signal. At a basic level, a high-power directional coupler causes a sample of an electromagnetic wave propagating on the through line to propagate on the coupled line. Therefore, the coupled line serves to sample the signal on the through line. A directional coupler is capable of sampling signals propagating in two different directions. A signal flowing in a first direction on the through line is sampled on one port of the coupled line, while a signal flowing in the opposite direction is sampled on the other port of the coupled line.

To measure output power or other high-power signals in a system, high-power handling capability is desirable for dual directional couplers. For example, dual directional couplers with high-power handling capabilities are well-suited to measure the output power of a base station within a cellular network. High-power directional couplers are also well-suited to measure the return loss of base station antennas by measuring both the forward power, which propagates from the base station to the antenna, and also the reverse power, which is reflected from the antenna and propagates in the opposite direction.

Although such directional couplers, including dual directional couplers, are known, for example, from U.S. Pat. Nos. 6,066,994, 6,573,807 and 6,600,307, all known directional couplers suffer from a number of disadvantages, particularly in their design and their manufacturability.

SUMMARY OF THE INVENTION

The dual directional coupler in accordance with the present invention has two directional couplers constructed in one compact structure, where each coupler shares one, common main line. The couplers are designed asymmetrically, and are two quarter-wave sections long, transmission line couplers. The coupler is built using airline, (also known as slab line) technology.

Although it is possible to design a dual directional coupler that would function somewhat similarly using a single quarter-wave section, the much more difficult design of a multi section, quarter-wave dual directional coupler is employed by the present invention. An advantage of the multi section design is wider bandwidth of operation can be realized as compared with single section design.

One prime example of an application of such a coupler is independently monitoring forward and reverse power flowing through the coupler. This measurement could be used to calculate Voltage Standing Wave Ratio (VSWR) of the load attached to the coupler. One example of such a load could be an antenna of a wireless base station. In this case a coupler constructed according to the present invention could be used to monitor the condition of the base station antenna and associated feeder line.

One object of the present invention is to provide a design of the coupled region of a dual directional coupler, as shown on FIG. 6, where the quarter wave coupled conductors share the same length as that of the main line, but each have a different coupling coefficient value.

It is a further object of the present invention to provide a multi section airline coupler design where the coupling coefficient of different quarter wave sections is obtained by a reduction of the ground space distance in the area located away from the main line.

It is yet another object of the present invention to provide a multi section directional coupler where various coupling coefficients are obtained by varying the ground space located over the coupled conductor, where abrupt change in the ground plane distance take place in the area between the center line of the main and the center line of the coupled conductor.

A further object of the present invention is to provide a dual directional coupler capable of having two couplers inside a common housing, so as to allow for independent measurements of forward and reverse power in one compact design.

It is yet another object of the present invention to provide a directional coupler, using airline coaxial transmission line structures, resulting in features such as extremely low dissipative loss and high RF power handling over an extended frequency range.

A further object of present invention is to provide a coupler having negligible passive inter-modulation distortion products (PIM).

It is still a further object of the present invention to provide a directional coupler which is rugged, mechanically stable, and of a construction to make it applicable to both indoor and outdoor applications where high mechanical stresses and extreme weather conditions are present.

These and other objects of the present invention are achieved in accordance with one embodiment of the present invention by provision of a dual directional coupler that includes a housing, a main conductor, a forward coupled conductor and a reverse coupled conductor. The main conductor, the forward coupled conductor and the reverse coupled conductor are arranged in parallel within the housing such that the main conductor and the forward coupled conductor define a first two section quarter wave directional coupler, and the main conductor and the reverse coupled conductor define a second two section quarter wave directional coupler.

In some embodiments, the forward coupled conductor and the reverse coupled conductor comprise multi-stepped rods, each rod having at least two sections having different cross-sectional diameters concentric to one axis. In certain of these embodiments, a coupling value of each rod section is variable by affecting a change in a ground space distance for each rod section. In some embodiments, the main conductor comprises a rod having a constant cross-sectional diameter. In some embodiments, the main conductor is located centrally inside the housing by means insulator supports.

In some embodiments, the main conductor, the forward coupled conductor and the reverse coupled conductor are disposed within a single plane, with axes thereof all being generally parallel to one another. In certain of these embodiments, the main conductor is disposed between the forward coupled conductor and the reverse coupled conductor, and the forward coupled conductor and the reverse coupled conductor are generally equally spaced from the main conductor.

In some embodiments, the dual directional coupler further includes an input connector and an output connector mounted on the housing and connected to the main conductor to provide a path for main power flow through the coupler. In certain of these embodiments, the dual directional coupler further includes a forward coupled power connector mounted on the housing and connected to the forward coupled conductor such that a small amount of the main power flow, flowing in a forward direction, is coupled to the forward coupled conductor and is available at the forward coupled power connector. In certain of these embodiments, the dual directional coupler further includes a reverse coupled power connector mounted on the housing and connected to the reverse coupled conductor such that a small amount of the main power flow, flowing in a reverse direction, is coupled to the reverse coupled conductor and is available at the reverse coupled power connector.

In some embodiments, the main conductor, the forward coupled conductor and the reverse coupled conductor each comprises a machined one-piece rod. In some embodiments, the first and second two section quarter wave directional couplers each comprises an asymmetric coupler. In certain of these embodiments, the dual directional coupler further includes terminations attached to each of the forward coupled conductor and the reverse coupled conductor in order to provide a good electrical match for the coupled conductors and good overall directivity of the coupler. In some embodiments, the dual directional coupler further includes dielectric strips disposed within the housing for enhancing directivity of the coupler.

The invention and its particular features and advantages will become more apparent from the following detailed description considered with reference to the accompanying drawings.

DETAILED DESCRIPTION OF AN EMBODIMENT OF THE INVENTION

Figure 1:
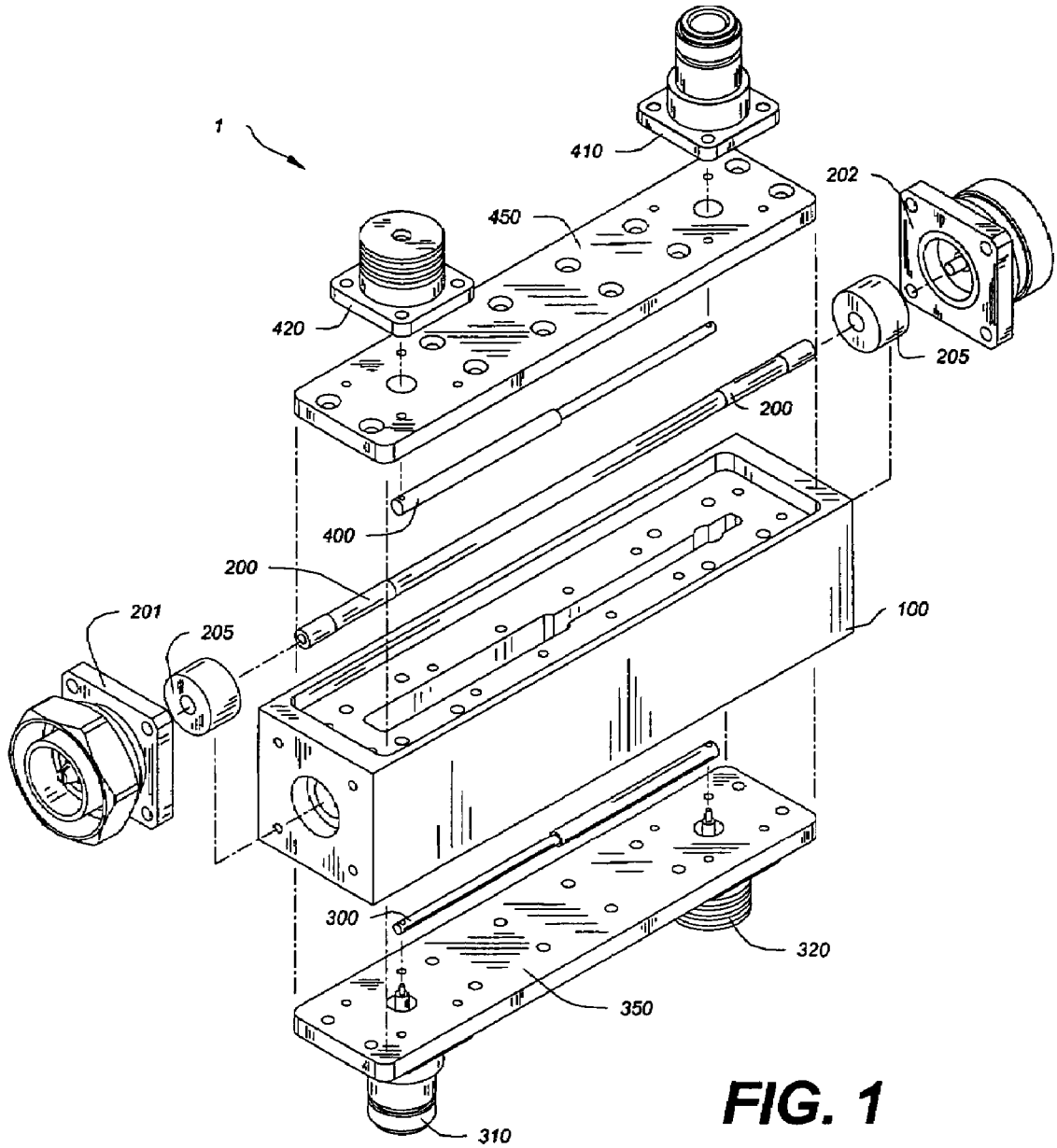
FIG. 1 is an isometric exploded view of a dual directional coupler in accordance with an exemplary embodiment of the present invention.
Figure 2A:
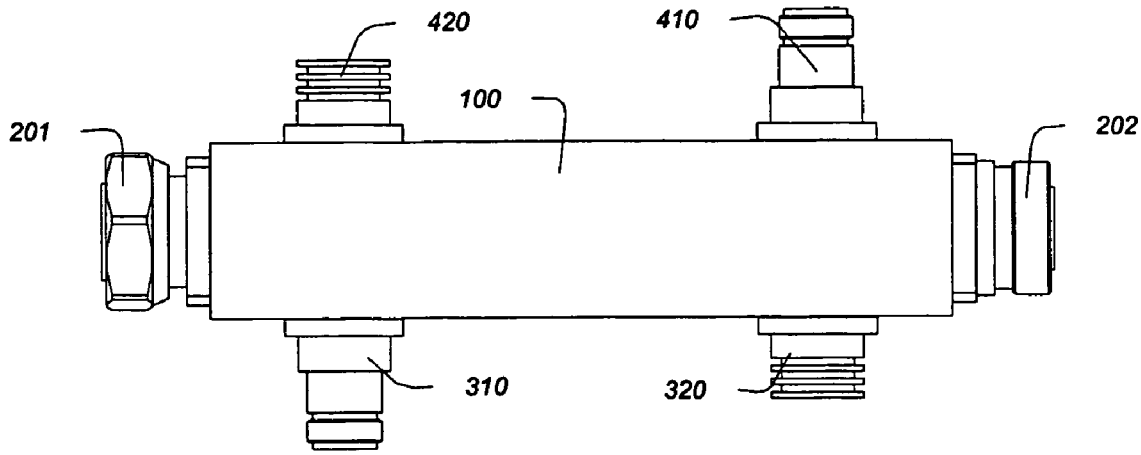
FIGS. 2A and 2B are, respectively, side elevational and top plan views of the dual directional coupler of FIG. 1.
Figure 2B:
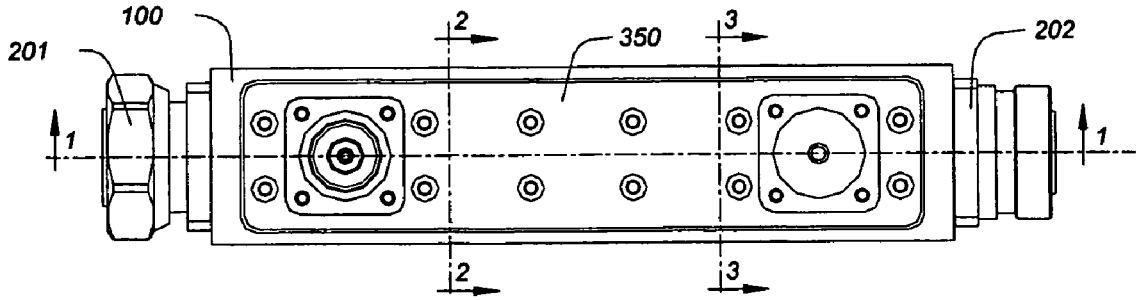

Referring first to FIGS. 1, 2A and 2B, a dual directional coupler (1) in accordance with the present invention is shown. As best shown in FIG. 1, the dual directional coupler (1) includes a housing (100), a main conductor (200), and a forward coupled conductor (300) as well as a reverse coupled conductor (400). The main line (200) along with the forward coupled conductor (300) form one, two section quarter wave coupler, while the same main line (200) and the reverse coupled line (400) form yet another two section directional coupler. The same main line (200) is shared by both couplers which allows for the compact design of this dual directional coupler (1). An alternate design would require two couplers positioned in series along the same main line, thus increasing the total length of the coupler by a factor of two.

The main conductor (200) is located centrally inside the housing (100) by means of the insulator supports (205), as shown in FIG. 1. The input connector (201) and the output coaxial connector (202) are connected to the main line (200) and provide a path for the main power flow through the coupler (1). A small amount of this power, flowing in the forward direction, will be coupled to the forward conductor (300) and is available at the forward coupled power connector (310), as shown in FIGS. 1 and 2A. Respectively, a small amount of the power traveling in the reverse direction, from the output connector (202) to the input connector (201), will be coupled to the reverse coupled conductor, (400) and is available at the reverse coupled connector (410), as shown in FIGS. 1 and 2A.

All conductors (200, 300, 400) of the present invention are machined as one piece rods using standard turning machines. Coupling variation between quarter-wave sections is obtained through the variation of the ground space distance. The distance between centers of the conductors remains fixed through all coupled sections. Thus, in accordance with the dual directional coupler of the present invention, two couplers (300, 400) are positioned on one plane on either side of the shared main transmission line (200). The main transmission line diameter remains constant over all quarter-wave sections.

Thus, the present invention provides for parallel arrangement of all three coupled conductors; the main line (200) and two coupled (300, 400) conductors. The coupled conductors (300, 400) are machined as multi-step rods having at least two different diameters concentric to one axis. The correct coupling value of each rod section (i.e., each section having a different diameter) is obtained by affecting a change in the ground space distance.

The housing (100) is made of 1.5 inch square aluminum, whereas all conductors and connectors are made of brass. To prevent oxidization and provide good PIM performance and low insertion loss, all brass parts are silver-plated and the aluminum housing is protected against corrosion using a chemical conversion coating.

As is known, asymmetric couplers have coupled sections arranged consecutively from low to high, while symmetric couplers would have the tightest coupled section located in the middle of the structure. Although the exemplary embodiment of the current invention is shown as a two section asymmetric coupler, it should be understood that multiple section design is feasible using methods outlined herein.

To provide a good electrical match for the coupled conductor and good overall directivity of the coupler, terminations (420) and (320), as shown in FIGS. 1 and 2A, which are preferably 50 ohm terminations, are used. Power connector (310) and termination (320) may be attached to a plate (350), as shown in FIGS. 1 and 2B, while power connector (410) and termination (420) may be attached to a plate (450), as shown in FIG. 1, which plates (350, 450) are attached to housing (100) during manufacture of coupler (1).

The two couplers (300, 400) share the same length of the main transmission line (200) and are separated by 180 degrees. In the case of asymmetric couplers, one side of the coupler can exhibit better directivity than the other. This measurement is accomplished by empirical tests, and in accordance with the present invention, the tight end of the coupler is used as the output port (310,410), while the loose end is terminated into the 50 ohm termination (320, 420). In this way, the directivity obtained is close to, or better than, 30 dB.

The coupler design is a two quarter wave section design with the coupled conductors having two distinctive diameters required for correct impedance match for the loose and tight coupled sections.

Although it is possible for a single section coupler to have all conductors in a parallel configuration, the difference in coupling values for a multi section coupler design requires varying separation between the main and coupled conductors. In such a case, the machining of the coupled conductors requires an offset between the centerlines of each section. The present invention allows for an equal distance of all coupled sections from the main line, and all sections are located along one common axis.

Figure 3:
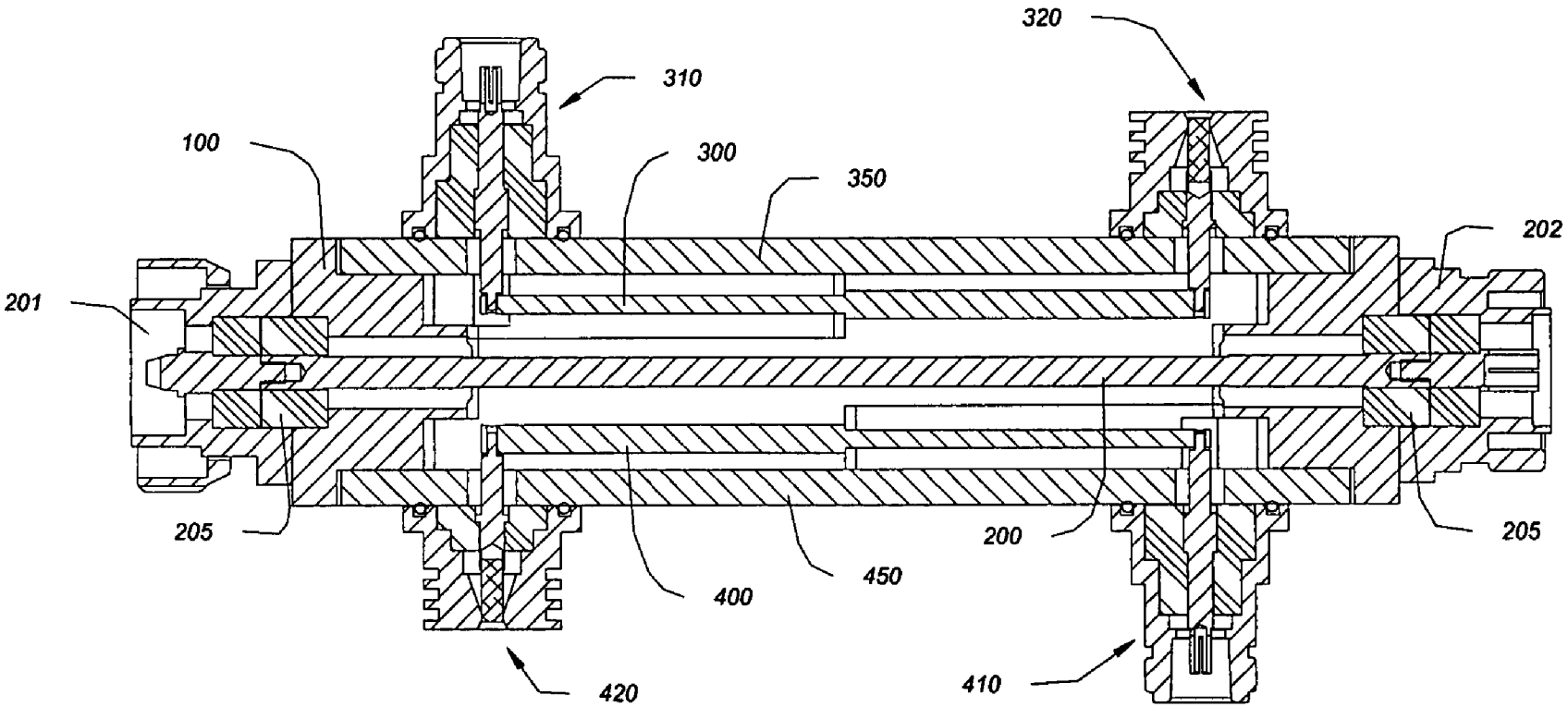
FIG. 3 is a cross-sectional view of the dual directional coupler taken along line 1-1 in FIG. 2B.

Referring now to FIG. 3 the parallel arrangement of the coupled conductors (300) and (400) to the main conductor (200) is shown. The coupled conductor (300), including power connector (310), termination (320) and plate (350), along with the main conductor (200), including input connector (201), output coaxial connector (202), and insulator supports (205), forms the forward two section quarter-wave directional coupler. Respectively, the coupled conductor (400), including power connector (410), termination (420) and plate (450), along with the main conductor (200), including input connector (201), output coaxial connector (202), and insulator supports (205), forms the reverse two section quarter-wave directional coupler.

The two section coupled conductor is machined from one piece of metal, with all diameters concentric to each other. Also, machining detail of the housing (100) is shown above the loose coupled section of the coupler. This machined step reduces ground plane spacing of the loose coupled section of the coupled conductor. It is the intention of this invention to select this step in such a way that all diameters of the coupled conductor lay along the axis parallel to the main conductor.

Figure 4:
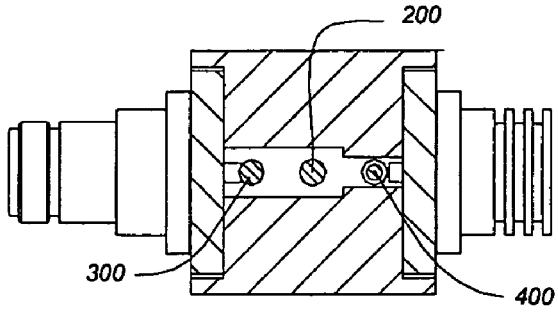
FIG. 4 is a cross-sectional view of the dual directional coupler taken along line 2-2 in FIG. 2B.

FIG. 4 shows a cross section taken along plane 2-2 as shown on Fig 2B. This plane corresponds to the location of the left most coupled sections of the dual directional coupler (1). Shown here is the ground space distance over conductor (400) being smaller than the one over the main line (200) and the coupled conductor (300).

Figure 5:
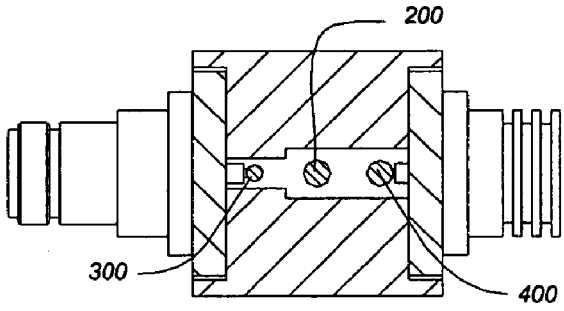
FIG. 5 is a cross-sectional view of the dual directional coupler taken along line 3-3 in FIG. 2B.

Similarly, FIG. 5 shows a cross section taken along plane 3-3 as shown on Fig 2B. What is detailed is the ground space arrangement that is reversed compared to FIG. 4. The smaller ground space is over the conductor (300), which had largest ground space in the previous view, while the main line (200) ground spacing stays unchanged and the ground space over conductor (400) is now larger.

As can be seen in FIGS. 4 and 5, variations in the coupling coefficient are obtained by changing the coupled conductor (300, 400) diameter and ground space distance. The relatively large ground plane spacing is obtained along the main line (200), thus increasing the power handling characteristics of the coupler (1).

Figure 6:
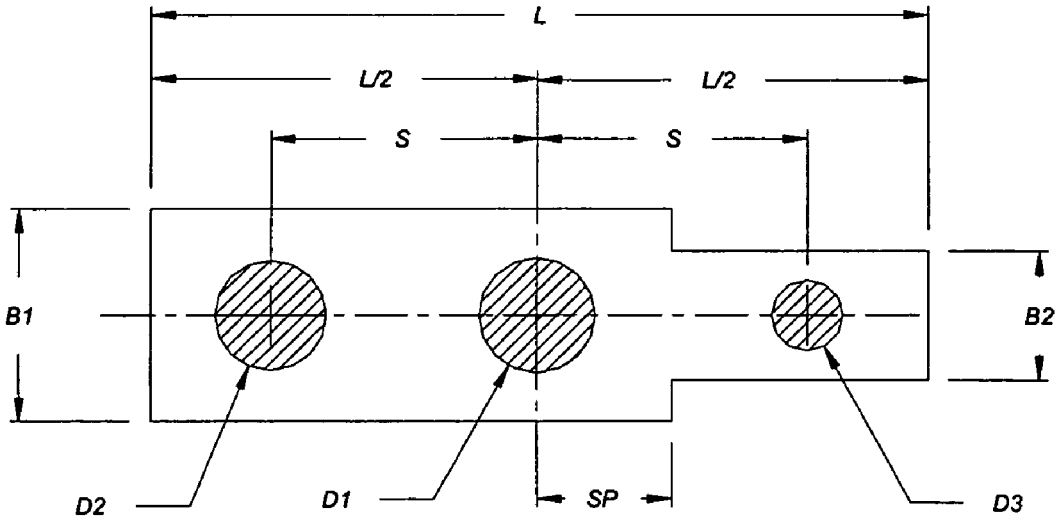
FIG. 6 is a schematic representation of the geometric variables employed to design the dual directional coupler of FIG. 1.

FIG. 6 illustrates geometric variables used to design couplers according to the present invention. What is shown is the ground space change from (B1) to (B2) taking place at distance (SP) from the main line (200), e.g. as shown in FIG. 4. Furthermore, the distance (S) of coupled sections remains constant along all coupled sections of the present invention, even through the diameters (D2, D3) of the coupled conductors (300, 400) change over the length thereof and the diameter (D1) of the main conductor (200), e.g. as shown in FIG. 4, remains constant. FIG. 6 also illustrates how the main conductor (200) is equally spaced by distance (L/2) within the housing of total distance L.

Figures 7, 8:
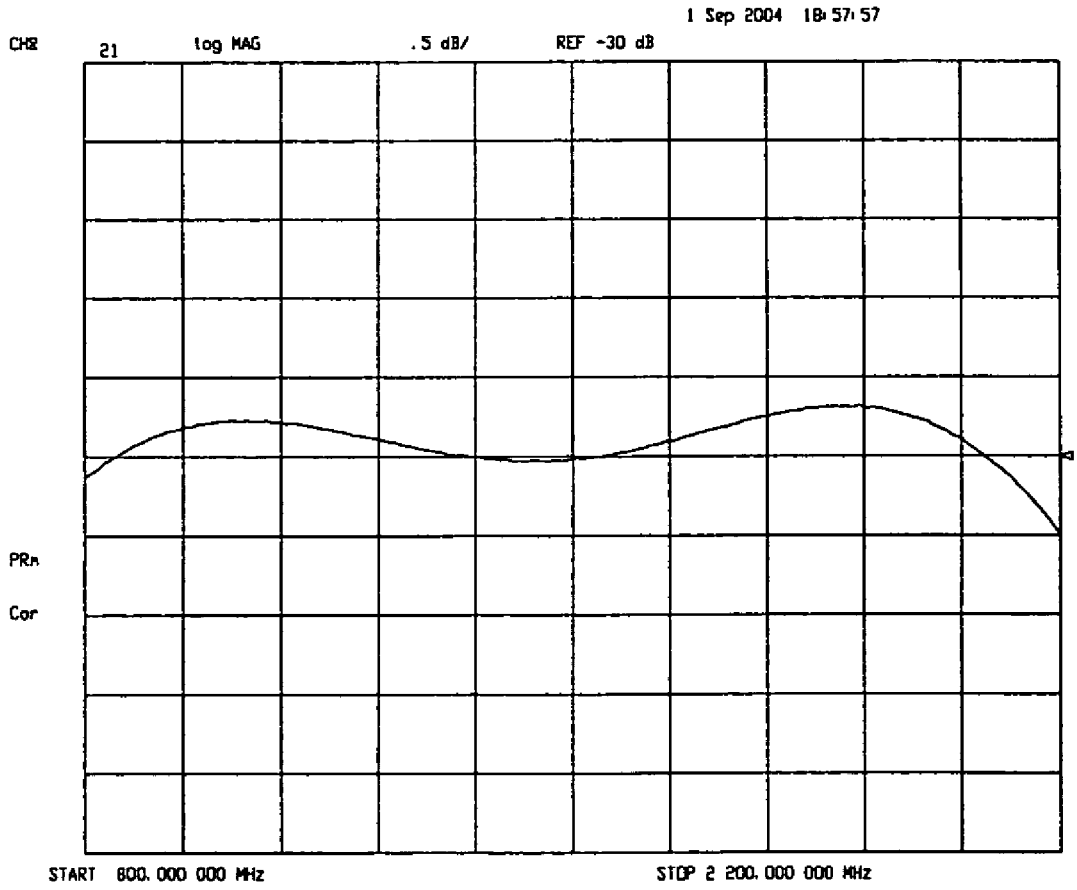
FIG. 7 illustrates sample dimensions for the geometric variables of FIG. 6 employed to design the dual directional coupler of FIG. 1.
FIGS. 8 and 9 illustrate sample directivity measurements of the dual directional coupler of FIG. 1.

FIG. 7 illustrates sample mechanical dimensions used in manufacturing a 30 dB dual directional coupler according to the present invention, which dimensions correspond to those (L, B1, B2, SP, S, D1, D2, D3) shown in FIG. 6.

Figure 9:
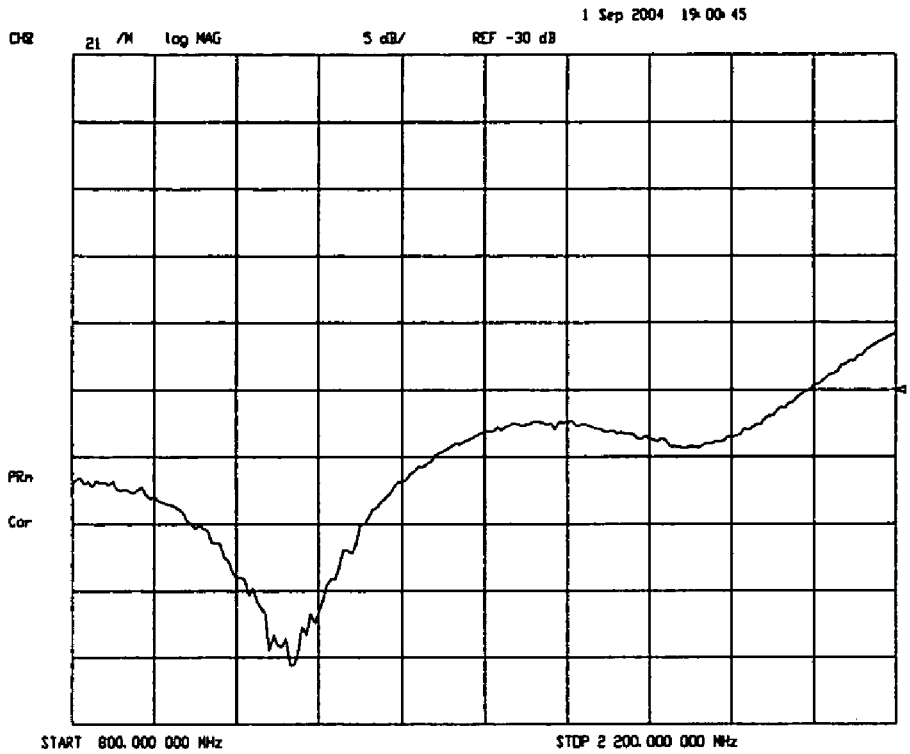

FIGS. 8 and 9 illustrate directivity measurements for the 30 dB dual directional coupler manufactured according with the present invention. More specifically, FIG. 8 graphically shows measured data for the coupled value of power from the main line, for both forward and reverse coupling of a two-section coupler design in accordance with the present invention. FIG. 9 graphically shows measured data of one of the two directional couplers in a dual directional coupler of the present invention. As is known to those skilled in the art, directivity is a parameter whose performance and specification determines the quality and attributes of a directional coupler. The higher the directivity number, expressed in dB, the more accurate the value of the forward coupling value or determination of forward coupling value, and independence of load reflections or reverse power coming from the load on the main line of the directional coupler. The result is improved accuracy of both forward and reverse power measurement.

Figure 10:
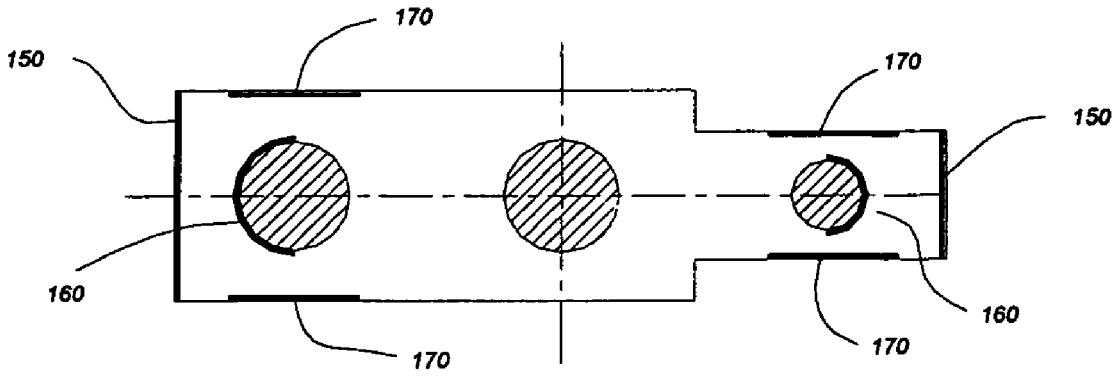
FIG. 10 is a schematic representation showing possible locations for the placement of optional dielectric strips within the dual directional coupler of FIG. 1.
Figure 11:
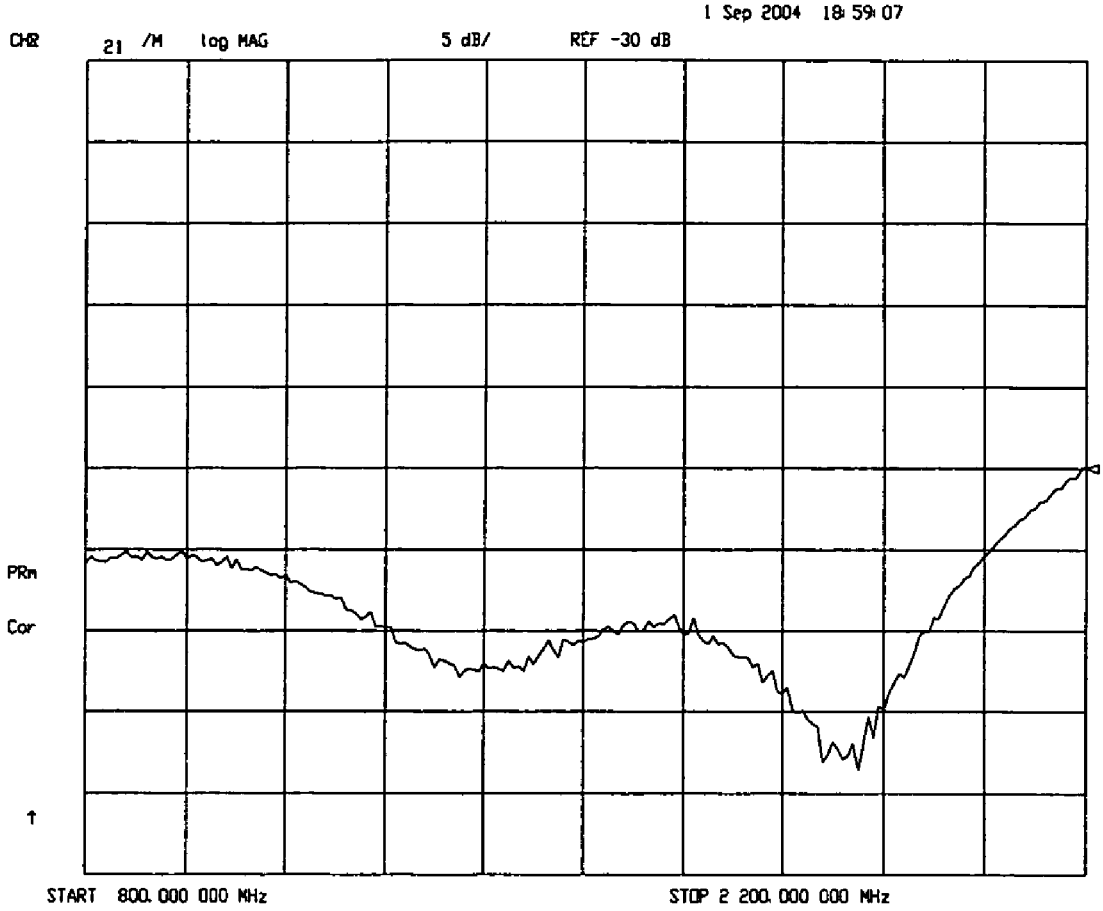
FIG. 11 illustrate sample directivity measurements of the dual directional coupler of FIG. 1 when the optional dielectric strips are employed.

Further enhancement of the directivity is obtained by employing dielectric strips (150, 160, 170) as shown on FIG. 10. The dielectric strips could be made of, for example, TEFLON® fluoropolymer tape or KAPTON® polyimide film tape. FIG. 10 shows several possible locations of the dielectric strips used to enhance directivity of the couplers built according to the present invention. FIG. 11 shows directivity improvement by using the dielectric strip (160) as shown in FIG. 10. More specifically, FIG. 11 graphically shows measured data for directivity after incorporating the aforementioned improvements discussed in connection with FIG. 10. As shown, directivity increased by 5 dB or more as compared with FIG. 9.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A dual directional coupler comprising:

a housing;

a main conductor;

a forward coupled conductor;

a reverse coupled conductor;

wherein said main conductor, said forward coupled conductor and said reverse coupled conductor are arranged in parallel within said housing such that said main conductor and said forward coupled conductor define a first two section quarter wave directional coupler, and said main conductor and said reverse coupled conductor define a second two section quarter wave directional coupler; and wherein said main conductor, said forward coupled conductor and said reverse coupled conductor each comprises a machined one-piece rod.

2. The dual directional coupler of claim 1 wherein said forward coupled conductor and said reverse coupled conductor comprise multi-stepped rods, each multi-stepped rod having at least two sections having different cross-sectional diameters concentric to a common axis.

3. The dual directional coupler of claim 2 wherein a coupling value of each rod section is variable by affecting a change in a ground space distance for each rod section.

4. The dual directional coupler of claim 1 wherein said main conductor comprises a rod having a constant cross-sectional diameter.

5. The dual directional coupler of claim 1 wherein said main conductor is located centrally inside said housing by insulator supports.

6. The dual directional coupler of claim 1 wherein said main conductor, said forward coupled conductor and said reverse coupled conductor are disposed within a single plane, with axes thereof all being generally parallel to one another.

7. The dual directional coupler of claim 6 wherein said main conductor is disposed between said forward coupled conductor and said reverse coupled conductor and wherein said forward coupled conductor and said reverse coupled conductor are generally equally spaced from said main conductor.

8. The dual directional coupler of claim 1 further comprising an input connector and an output connector mounted on said housing and connected to said main conductor to provide a path for main power flow through the coupler.

9. The dual directional coupler of claim 8 further comprising a forward coupled power connector mounted on said housing and connected to said forward coupled conductor such that a small amount of the main power flow, flowing in a forward direction, is coupled to the forward coupled conductor and is available at the forward coupled power connector.

10. The dual directional coupler of claim 9 further comprising a reverse coupled power connector mounted on said housing and connected to said reverse coupled conductor such that a small amount of the main power flow, flowing in a reverse direction, is coupled to the reverse coupled conductor and is available at the reverse coupled power connector.

11. The dual directional coupler of claim 1 further comprising dielectric strips disposed within said housing for enhancing directivity of the coupler.

12. The dual directional coupler of claim 1 wherein the first and second two section quarter wave directional couplers each comprises an asymmetric coupler.

13. The dual directional coupler of claim 12 further comprising terminations attached to each of said forward coupled conductor and said reverse coupled conductor in order to provide a good electrical match for the coupled conductors and good overall directivity of the coupler.

14. A dual directional coupler comprising:

a housing;

a main conductor, said main conductor comprising a rod having a constant cross-sectional diameter;

a forward coupled conductor, said forward coupled conductor comprising a multi-stepped rod having at least two sections having different cross-sectional diameters commonly concentric to an axis of the forward coupled conductor;

a reverse coupled conductor, said reverse coupled conductor comprising a multi-stepped rod having at least two sections having different cross-sectional diameters commonly concentric to an axis of the reverse coupled conductor;

said main conductor, said forward coupled conductor and said reverse coupled conductor being disposed within a single plane, with axes thereof all being generally parallel to one another, and with said main conductor being disposed between said forward coupled conductor and said reverse coupled conductor with said forward coupled conductor and said reverse coupled conductor being generally equally spaced from said main conductor; and wherein said main conductor, said forward coupled conductor and said reverse coupled conductor are arranged in parallel within said housing such that said main conductor and said forward coupled conductor define a first two section quarter wave directional coupler, and said main conductor and said reverse coupled conductor define a second two section quarter wave directional coupler.

15. The dual directional coupler of claim 14 further comprising dielectric strips disposed within said housing for enhancing directivity of the coupler.

16. The dual directional coupler of claim 14 wherein a coupling value of each rod section is variable by affecting a change in a ground space distance for each rod section.

17. The dual directional coupler of claim 14 wherein said main conductor is located centrally inside said housing by insulator supports.

18. The dual directional coupler of claim 14 further comprising an input connector and an output connector mounted on said housing and connected to said main conductor to provide a path for main power flow through the coupler.

19. The dual directional coupler of claim 18 further comprising a forward coupled power connector mounted on said housing and connected to said forward coupled conductor such that a small amount of the main power flow, flowing in a forward direction, is coupled to the forward coupled conductor and is available at the forward coupled power connector.

20. The dual directional coupler of claim 19 further comprising a reverse coupled power connector mounted on said housing and connected to said reverse coupled conductor such that a small amount of the main power flow, flowing in a reverse direction, is coupled to the reverse coupled conductor and is available at the reverse coupled power connector.

21. The dual directional coupler of claim 14 wherein said main conductor, said forward coupled conductor and said reverse coupled conductor each comprises a machined one-piece rod.

22. The dual directional coupler of claim 14 wherein the first and second two section quarter wave directional couplers each comprises an asymmetric coupler.

23. The dual directional coupler of claim 22 further comprising terminations attached to each of said forward coupled conductor and said reverse coupled conductor in order to provide a good electrical match for the coupled conductors and good overall directivity of the coupler.

24. A dual directional coupler comprising:

a housing;

a main conductor;

a forward coupled conductor;

a reverse coupled conductor;

wherein said main conductor, said forward coupled conductor and said reverse coupled conductor are arranged in parallel within said housing such that said main conductor and said forward coupled conductor define a first two section quarter wave directional coupler, and said main conductor and said reverse coupled conductor define a second two section quarter wave directional coupler; and wherein said forward coupled conductor and said reverse coupled conductor comprise multi-stepped rods, each multi-stepped rod having at least two sections having different cross-sectional diameters concentric to a common axis.

25. The dual directional coupler of claim 24 further comprising dielectric strips disposed within said housing for enhancing directivity of the coupler.

26. The dual directional coupler of claim 24 wherein a coupling value of each rod section is variable by affecting a change in a ground space distance for each rod section.

27. The dual directional coupler of claim 24 wherein said main conductor comprises a rod having a constant cross-sectional diameter.

28. The dual directional coupler of claim 24 wherein said main conductor is located centrally inside said housing by insulator supports.

29. The dual directional coupler of claim 24 wherein said main conductor, said forward coupled conductor and said reverse coupled conductor are disposed within a single plane, with axes thereof all being generally parallel to one another.

30. The dual directional coupler of claim 29 wherein said main conductor is disposed between said forward coupled conductor and said reverse coupled conductor and wherein said forward coupled conductor and said reverse coupled conductor are generally equally spaced from said main conductor.

31. The dual directional coupler of claim 24 further comprising an input connector and an output connector mounted on said housing and connected to said main conductor to provide a path for main power flow through the coupler.

32. The dual directional coupler of claim 31 further comprising a forward coupled power connector mounted on said housing and connected to said forward coupled conductor such that a small amount of the main power flow, flowing in a forward direction, is coupled to the forward coupled conductor and is available at the forward coupled power connector.

33. The dual directional coupler of claim 32 further comprising a reverse coupled power connector mounted on said housing and connected to said reverse coupled conductor such that a small amount of the main power flow, flowing in a reverse direction, is coupled to the reverse coupled conductor and is available at the reverse coupled power connector.

34. The dual directional coupler of claim 24 wherein said main conductor, said forward coupled conductor and said reverse coupled conductor each comprises a machined one-piece rod.

35. The dual directional coupler of claim 24 wherein the first and second two section quarter wave directional couplers each comprises an asymmetric coupler.

36. The dual directional coupler of claim 35 further comprising terminations attached to each of said forward coupled conductor and said reverse coupled conductor in order to provide a good electrical match for the coupled conductors and good overall directivity of the coupler.

* * * * *